United States Patent [19]

Mayes

[11] 3,981,525

[45] Sept. 21, 1976

[54] SECURITY APPARATUS FOR LOUVER WINDOWS AND DOORS

[76] Inventor: George C. Mayes, 1512 Ellsmere Ave., Los Angeles, Calif. 90019

[22] Filed: Apr. 28, 1975

[21] Appl. No.: 572,011

[52] U.S. Cl. ..... 292/259 R

[51] Int. Cl.[2] ..... E05C 19/18

[58] Field of Search ..... 292/345, 260, 259, 258, 292/288

[56] References Cited

UNITED STATES PATENTS 2,523,392 9/1950 Rabinowitz et al. ..... 292/345 X 3,282,618 11/1966 Adickes ..... 292/258

*Primary Examiner*—Richard E. Moore

*Attorney, Agent, or Firm*—Booker T. Hogan, Jr.

[57] ABSTRACT

A security device for louvered windows has been disclosed. This device consists of a bar having four clips and is adaptable to almost all louvered windows having aluminum hardware. When attached properly, it precludes the removal of glass slats from the window and makes it impossible to open the window without breaking out the glass.

8 Claims, 7 Drawing Figures

SECURITY APPARATUS FOR LOUVER WINDOWS AND DOORS

BACKGROUND OF THE INVENTION

1. Field of the Invention.

This invention is related to the field of security devices in general and to security devices for louvered windows in particular.

2. Prior Art.

Louvered windows or doors enjoy wide spread acceptance in the building industry. However, they have an inherent design characteristic which tends to make them unacceptable when security factors are considered. They are extremely difficult to secure against an unwanted entry. i.e., there are no practical ways to lock louvered windows or doors.

This defect or design weakness can be understood by refering to FIG. 2 which shows a closed louvered window comprised of louver window hardware 10 and louver window glasses or slats 12 held in place by louver lite brackets 13.

The glass slats are subject to removal, without fracture, by the exertion of an upward force on the bottom edge of a slat which causes the light weight (usually aluminum) upper clip 14 of the louver lite bracket 13 to yield. Once key slats have been removed, the louver window operator 15 may be used to open the window (FIG. 2) thereby facilitating the subsequent removal of all remaining slats without any significant difficulty.

There have been several attempts to solve the problem described above by either gluing the glass slats in the louver lite brackets or fabricating louver light brackets which completely encircle the ends of the glass slats. The techniques proved to be both ineffective and costly.

It is possible to devise a lock to preclude the operation of the louver window operator 15. However this technique would not preclude the sequential removal of as many glass slats as is required to facilitate an entry.

THE INVENTION

SUMMARY

Given the above definition of the problem and the apparent lack of solution, it may be understood that it is the object of this invention to provide a means for securing louvered windows and doors.

A second object of this invention of to provide a means of precluding the removal of glass slats or panes from louvered windows or doors.

A still further object of this invention is to provide a relatively low cost louvered window and door security system.

The present invention meets the above objectives in that it can be fabricated from low cost stock materials and fitted to almost any aluminum framed louver window or door hardware.

The novel apparatus or device consist of a vertical blocking member comprised of a metallic bar or channel having four adjustable clips for attachment to louver window or door hardware and functions as a louvered window or door security system.

The device while functioning as a lock is not a lock within the accepted meaning of the term. It is completely detachable from the louvered hardware when not in use.

When adapted and attached to the hardware of an aluminum window or door, the device functions as a lock in that it precludes the opening or removability of the glass slats in the door or window.

BRIEF DESCRIPTION OF THE DRAWINGS:

The novel features which are characteristic of the invention both as its organization and method of operation, together with objects and advantages thereof, will be better understood from the following description considered in connection with the accompanying drawings in which like characters refer to like parts and in which.

Figure 1:
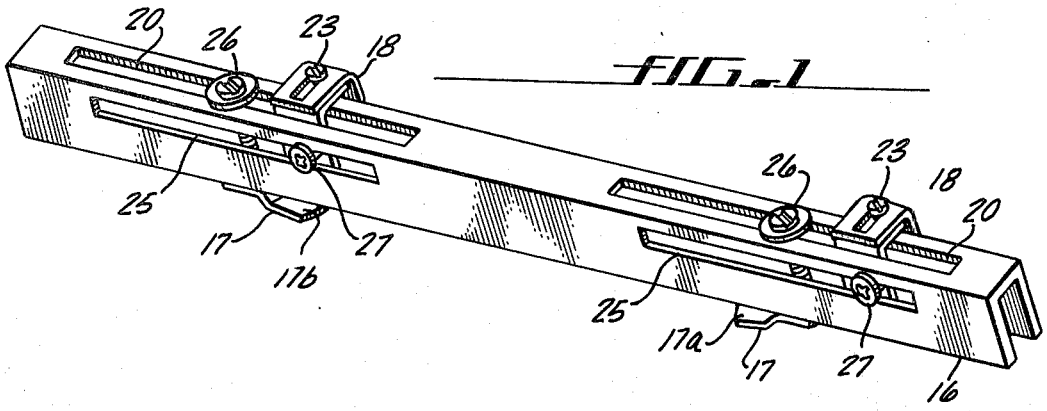
FIG. 1 is a perspective view of the invention.

DETAILED DESCRIPTION:

Referring to FIG. 1, the invention can be described as consisting of a vertical blocking member which maybe a metallic channel or bar 16 having two adjustable frontal fastening means 17 and two lateral fastening means 18.

The invention maybe adjusted to fit louvered windows or doors or varing demensions by changing the positions of the upper 17*a* and lower 17*b* frontal fastening means in the dorsal fastening means slots 20.

Figure 4:
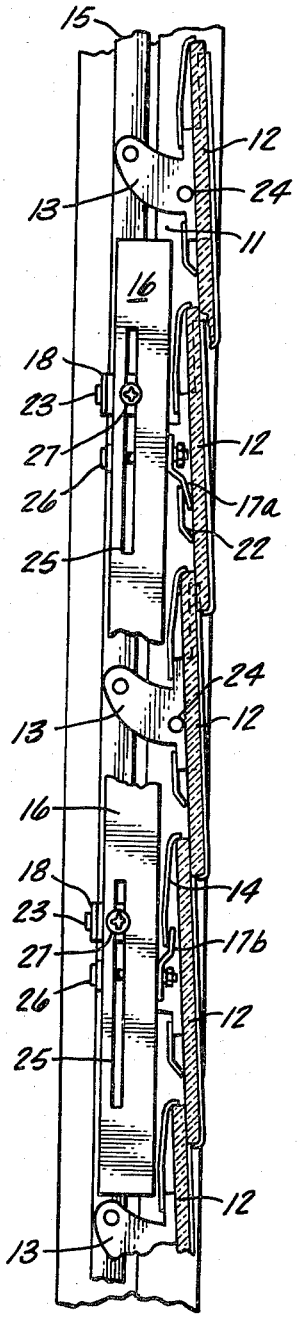
FIG. 4 is a side view of a closed louvered window having the invention placed in position.

In operation, the channel 16 acts as a bar to preclude the removal of glass slats 12 from the louver lite brackets 13 when it is firmly held in place against the louver lite brackets 13 by the frontal fastening means 17*a*, 17*b*, and anchored to the lateral louver operator 15 by the lateral fastening means 18 (see FIG. 4). The lower frontal fastening means 17*b* is oriented to clip under an upper louver lite bracket clip 14. Conversely the upper frontal fastening means 17*a* is orientated to clip over a lower louver lite bracket clip 22. This orientation precludes the removal of the blocking means 16 without releasing the tension applied to finger screws 23 or plunger bolts used to firmly attach the lateral fastening means 18 to the louver operator 15. The invention maybe removed or swung inward (away from the louver lite brackets) when it is not intended to function as a security system.

The blocking means also precludes one from opening the louver window or door in that it precludes the louver light brackets 13 from rotation or pivoting about their attachment points 24 on the louver hardware.

Although the invention shown in designed to be removed from the louver hardware when not in use, other embodiments maybe permanently attached to the louver hardware via employing hinged lateral fastening means. Inventions of this design would allow one to swing the channel or bar away from the louver lite brackets to permit the operation of the louver window operator which opens and closes the louver slats.

The invention has been used to secure louver window installations fabricated from aluminum metal primarily because the greatest number of existing louver window installations are fabricated from aluminum. However, the invention can be adopted to louver window hardware comprised of stainless steel or other metals.

Tests have show that one channel or bar is adequate per louver installation. However, two bars or channels per window would tend to increase the effectivity of the system.

The following example demonstrates how the currently preferred embodiment of the invention is made.

EXAMPLE

Referring again to FIG. 1, an extruded aluminum channel ¾ × ½ × ¾ inch 16 is cut to the length of a louvered window to be secured. Two dorsal fastening-means slots 3 inches long by ⅛ inch wide 20 are cut into the back of the channel approximately ½ to 1 inch from the respective ends of the channel. Two lateral adjustment slots 25 approximately 2½ inches long by ⅛ inch wide are cut along one side of the channel approximately one inch from the respective ends of the channel.

Two standard stainless steel Z–clips or mirror clips are connected to the front of the channel via No. 4 bolts and nuts 26 running through the dorsal fastening means 7 which hold the channel 6 firmly against fastening mean slots 20. These clipps function as frontal fastening means 7 which hold the channel 6 firmly against the louver lite brackets 13 in a closed position.

Adjustable J–shaped stainless stell brackets are inserted into the dorsal fastening-means slots 20 and attached to the inner wall of the channel via threaded screws 27 inserted into the lateral adjustment slots 25. Other adjustable J–shaped brackets are attached to the first J–shaped brackets on the dorsal portion of the channel with a threaded screw (23) to form an adjustable U–clamp which functions as lateral fastening means 18.

Figure 5:
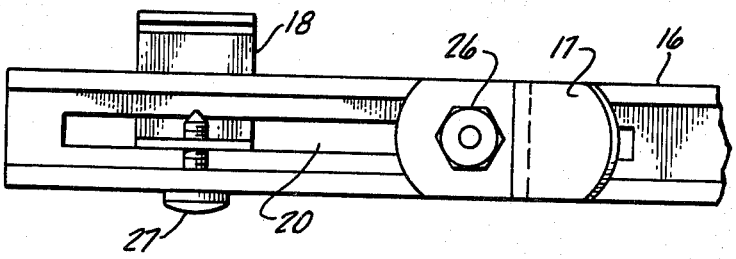
In FIG. 5 a plan view of the frontal surface of the invention is presented.
Figure 6:
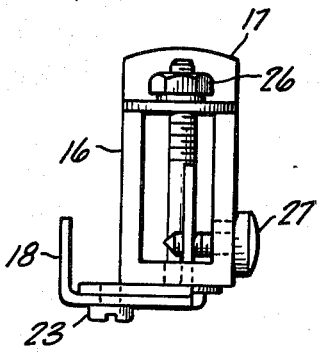
FIG. 6 shows a plan view of the top (or bottom) surface of the invention and FIG. 7 shows a plan view of a lateral surface of the invention.
Figure 7:
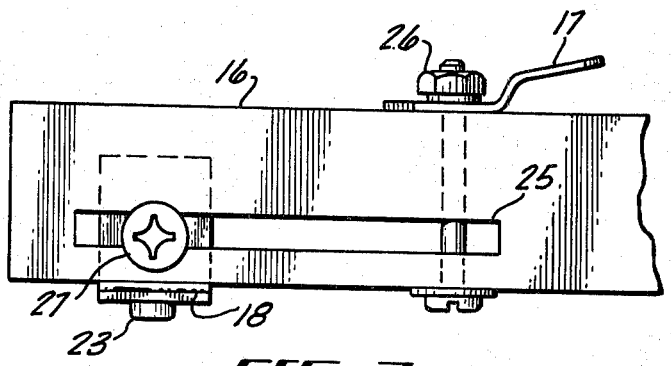
Figure 3:
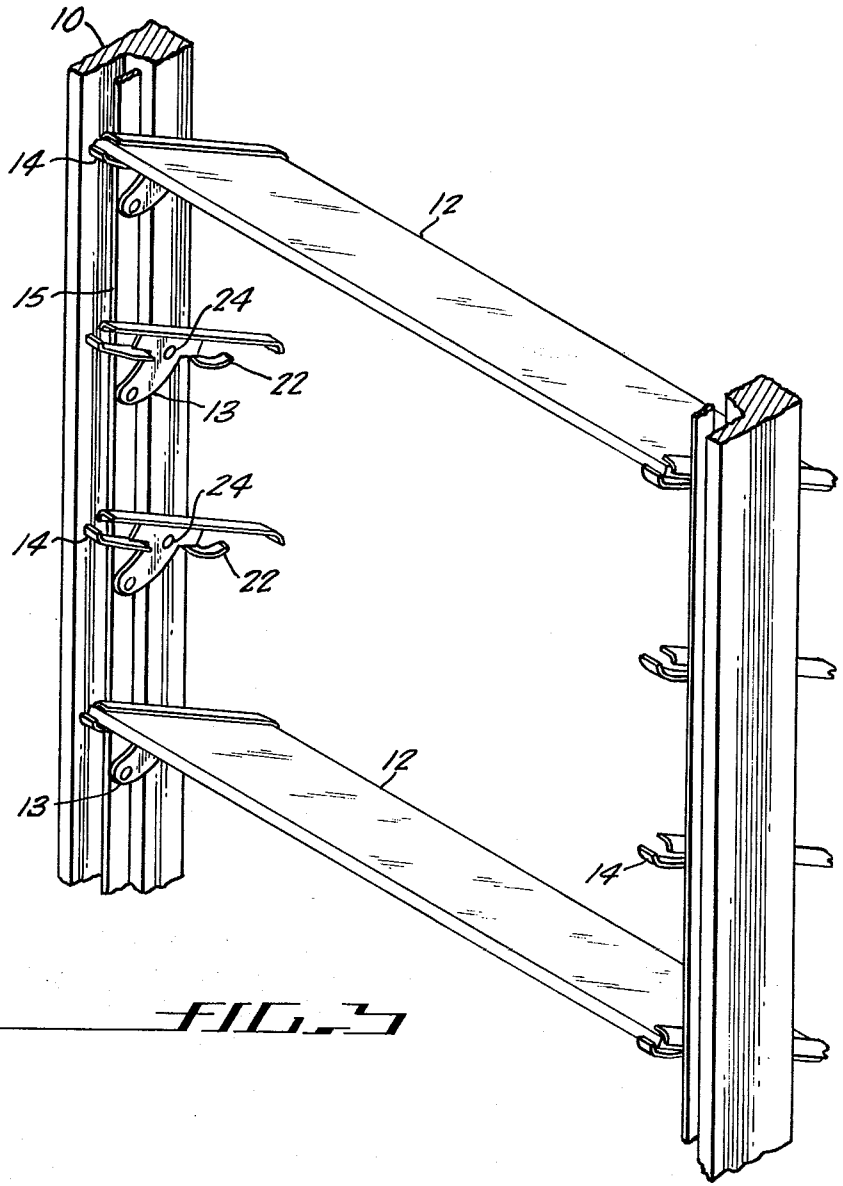
FIG. 3 is a prospective view of an open louvered window in which several glass slats have been removed.
Figure 2:
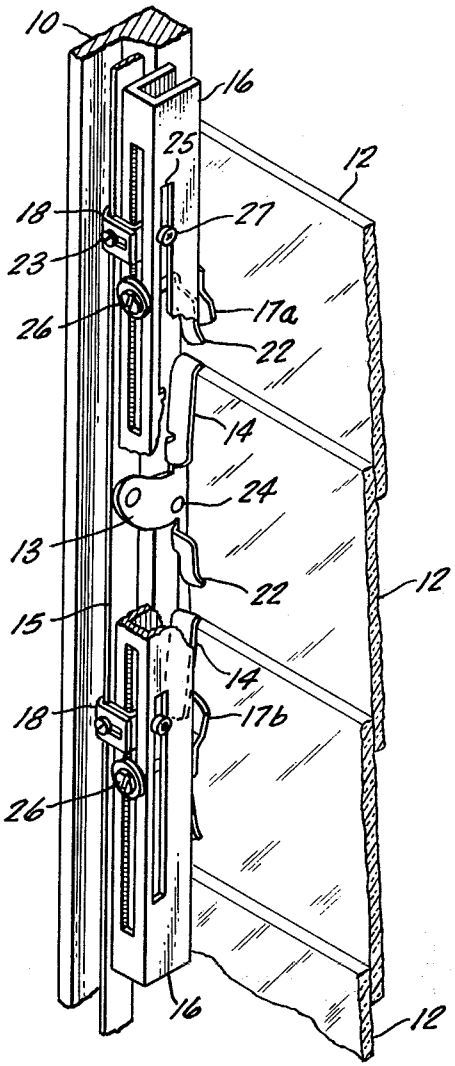
FIG. 2 is a prospective view of a closed louvered window.

Enlarged views of this assembly are shown in FIG. 5 6, and 7. While the example presented utilizes threaded screws to make the necessary attachments, other means such as wing nuts, finger screws, plunger blots etc. may be employed.

While the preferred embodiment of my invention is fabricated from aluminum, other metals and other rigid material may be used.

Having fully described my invention, disclosed its mode of operation and how to make it the scope of my claims maybe understood as follows:

I claim:

1. A security device for louver windows or doors having two lateral members and a multiplicity of louver lite brackets containing glass slats which open and close by rotating about attachment points on said members, wherein said security device is comprised of:

an elongated rectangular shaped vertical blocking member that is attachable to either of or both of said lateral members which prevents said brackets from rotating about said attachment point, lateral fastening means affixed to each end of said vertical blocking member for attaching said vertical blocking member to said lateral members and frontal fastening means affixed to said vertical blocking member whereby said vertical blocking member maybe clipped to said louver lite brackets.

2. The device of claim 1 wherein said blocking member is an extruded aluminum channel having slots on the dorsal and lateral surfaces of said channel at each end adapted for receiving said lateral fastening means and said frontal fastening means thereby rendering said blocking means adjustable to louver hardware of varying dimensions.

3. The device of claim 1 wherein said blocking member is an aluminum bar.

4. The device of claim 1 wherein said vertical blocking member is attached to said vertical member by a hinge.

5. The device of claim 1 wherein said blocking member is an extruded aluminum channel having longitudinal slots on the lateral and dorsal surfaces thereof and wherein said frontal fastening means are Z–clips affixed to said channel via bolts extending through said slots on said dorsal surface and said lateral fastening means consist of J–shaped brackets combined to form U–shaped clamps connected to said channel on said lateral surface via threaded screws.

6. The device of claim 5 wherein said blocking member is an aluminum bar.

7. The device of claim 5 wherein said blocking member is a plastic channel.

8. The device of claim 5 wherein said blocking member is a plastic bar.

* * * * *